United States Patent [19]

Nishi et al.

[11] 4,006,728

[45] Feb. 8, 1977

[54] ROOM HEATING APPARATUS USING COMBUSTION

[75] Inventors: Atsuyoshi Nishi; Shizuo Futaguchi; Akio Ishida, all of Nakatsugawa; Toshio Ito; Tamotsu Nomaguchi, both of Amagasaki; Toshihiko Makino; Tatsuo Saito, both of Nakatsugawa, all of Japan

[73] Assignee: Mitsubishi Denki Kabushiki Kaisha, Tokyo, Japan

[22] Filed: May 29, 1975

[21] Appl. No.: 581,948

Related U.S. Application Data

[60] Division of Ser. No. 475,841, June 3, 1974, abandoned, which is a continuation of Ser. No. 225,805, Feb. 14, 1972, abandoned.

[30] Foreign Application Priority Data

Feb. 13, 1971 Japan ..... 46-7696
Mar. 24, 1971 Japan ..... 46-17102

[52] U.S. Cl. ..... 126/110 R; 126/116 R; 239/568

[51] Int. Cl.[2] ..... F24H 3/10

[58] Field of Search ..... 126/110 R, 110 B, 116 R, 126/116 B; 239/568, 552, 553, 555, 566

[56] References Cited

UNITED STATES PATENTS

| | | | |
|---|---|---|---|
| 2,484,123 | 10/1949 | Scherl | 239/555 |
| 2,752,912 | 7/1956 | MacCracken | 126/110 R |
| 3,364,916 | 1/1968 | Wilkins et al. | 126/110 R |
| 3,382,862 | 5/1968 | Martz | 126/110 R |

*Primary Examiner*—William E. Wayner
*Assistant Examiner*—William E. Tapolcai, Jr.
*Attorney, Agent, or Firm*—Oblon, Fisher, Spivak, McClelland & Maier

[57] ABSTRACT

Room heating apparatus having a burner disposed in the upper part of a body to which air for combustion is forcibly supplied from a blower, a heat exchanger and a combustion chamber serially connected below the burner, and a second blower for recycling air from the room over the outer surfaces of the heat exchanger and the combustion chamber being disposed in the bottom of the body. The combustion chamber and the heat exchanger are substantially flat-shaped in configuration being on the order of ten times their thickness in both height and width.

Accordingly, the room heating apparatus is a compact heating unit having high thermal efficiency, and the blower for recycling air can be protected from damage due to heat of the burner, even in the event the blower is accidentally stopped.

11 Claims, 13 Drawing Figures

(a)

(b)

ROOM HEATING APPARATUS USING COMBUSTION

This is a division of application Ser. No. 475,841 filed June 3, 1974, now abandoned which in turn is a continuation of application Ser. No. 225,805, filed Feb. 14, 1972, now abandoned.

BACKGROUND OF THE INVENTION

1. Field of the Invention

This invention relates to an improved room heating apparatus from which the combustion gas is exhausted to the outdoors.

2. Description of the Prior Art

In conventional heating systems used for room heating wherein the combustion occurs in a combustion chamber having high sealing efficiency and the room is heated from an outer surface of the walls of the combustion chamber, and the combustion gas is exhausted to the outdoors, contamination of the air in the room being caused by the exhaust gas must be advantageously prevented. However, in doing so, it has been difficult at the same time to increase the thermal efficiency of the system. A blower generally is used for heating the air by causing it to contact the outer surface of the combustion chamber. However, when the blower is stopped for any reason, the blower becomes overheated by heat from the combustion chamber whereby damage may be caused thereto.

SUMMARY OF THE INVENTION

Accordingly, it is an object of the present invention to provide an improved room heating apparatus using a linear type burner and a combustion chamber and heat exchanger having a substantially flat shape and exhausting combustion gas to the outdoors which has excellent high thermal efficiency, such as about 90% thermal efficiency, such being unpredictable in comparison with conventional room heating apparatus exhausting combustion gas to the outdoors for which the thermal efficiency is about 70%.

Another object of the present invention is to provide uniform temperature distribution in a horizontal direction by using a linear type burner so as to prevent local increasing of temperature.

It is yet another object of this invention to provide a room heating apparatus wherein the blower for recycling air in the room is disposed below the combustion chamber and the heat exchanger and is not over-heated to be damaged by heat energy of the combustion chamber and the heat exchanger when it is accidentally stopped.

It is still another object of this invention to provide a room heating apparatus wherein the flow of the combustion gas passing through the combustion chamber and the heat exchanger is counter-current to the hot air flow passing the outer face of the combustion chamber and the heat exchanger.

A further object of this invention is to provide a combustion chamber and heat exchanger which are easily constructed and reliable in operation.

Yet a further object of this invention is to provide a linear typpe burner which provides stable combustion so as to be applicable for a compact type room heating apparatus.

These and other objects are attained, according to one aspect of the present invention, through the provision of a room heating apparatus having a linear type burner, a combustion chamber of substantially flat configuration wherein the linear type burner is disposed in the upper part and combustion is conducted in an inner space of the combustion chamber for transmitting heat energy to the outside thereof by heat exchange, a heat exchanger of substantially flat shape being provided below the combustion chamber and having an inner space thereof connected to the inner space of the combustion chamber for thereby passing the combustion gas from the inner space of the combustion chamber to the inner space of the heat exchanger for transmitting heat energy to the outer part of the heat exchanger, and an exhaust duct below the heat exchanger for exhausting combustion gas from the inner space of the heat exchanger to the outdoors. A blower also is provided below the heat exchanger for recycling the air in the room by passing it through the outer surfaces of the heat exchanger and the combustion chamber. If necessary, a guide plate may be provided to form passages of air between front plates of the combustion chamber and the heat exchanger and between back plates of the combustion chamber and the heat exchanger and, if desirable, both the front plates of the combustion chamber and the heat exchanger can be press-molded in one piece, and both the back plates of the combustion chamber and the heat exchanger can be also press-molded in one piece.

BRIEF DESCRIPTION OF THE DRAWINGS

Various other objects, features and attendant advantages of this invention will be more fully appreciated as the same becomes better understood from the following detailed description, when considered in connection with the accompanying drawings, where like reference numerals designate like or corresponding parts throughout the several Figures, and in which:

FIG. 5(*b*) is a cross-sectional view taken along the line V*b*–V*b* of FIG. 5(*a*);

FIG. 5 (*c*) is a partial slant of FIG. 5 (*b*);

FIG. 5 (*d*) is a front view of the flame hole plate of the burner shown in FIG. 5(*a*);

FIG. 5 (*e*) is a side view of the flame hole plate shown in FIG. 5 (*d*);

FIG. 5 (*f*) is a front view of another type of flame hole plate for the burner shown in FIG. 5(*a*);

FIG. 5(*g*) is a side view of the flame hole plate in FIG. 5(*f*);

DESCRIPTION OF THE ILLUSTRATED EMBODIMENTS

Figure 1:
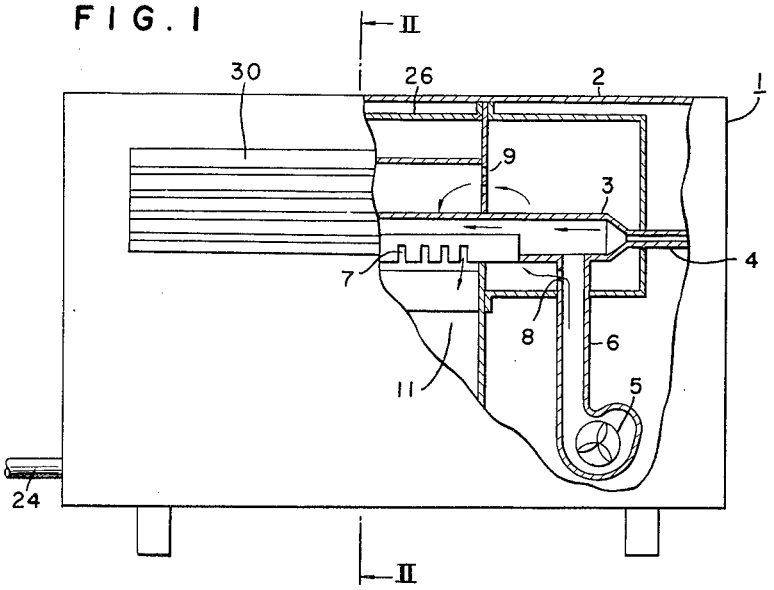
FIG. 1 is a schematic view of an embodiment of the room heating apparatus according to this invention being partly broken away and shown in section to illutrate the internal sectional structure thereof.
Figure 2:
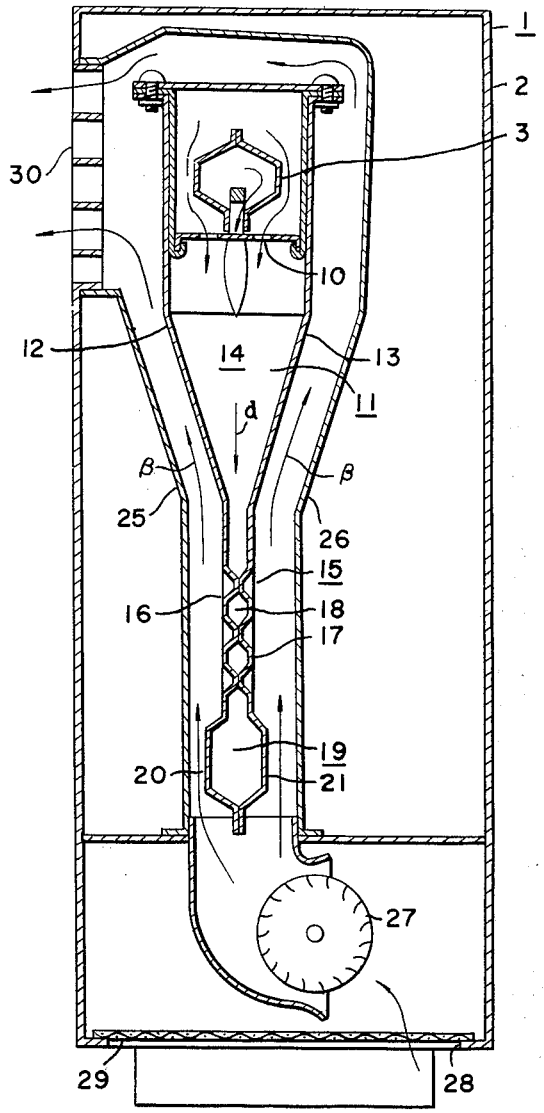
FIG. 2 is an enlarged cross-sectional view taken along the line II-13 II of FIG. 1.

Referring now to the drawings, and more particularly to FIGS. 1 and 2 thereof, one embodiment of the room heating apparatus of this invention is illustrated wherein the reference numeral 1 indicates a body of room heating apparatus using fuel gas, most of the body being covered by a sheath 2. A linear type burner 3 to which a fuel gas inlet pipe 4 is connected for supplying city gas, propane gas or the like is diposed in the body 1 and has an air inlet pipe 6 for supplying air from a blower 5 to feed a fuel gas preliminarily mixed with air thereinto. A plurality of flame holes 7 are provided on the lower side of the linear type burner 3 and some of the air being supplied from the blower 5 is by-passed through the openings 8, 9 and 10 to injected around the flame holes 7 so as to secondarily mix with the gas provided from the flame holes 7 in an elongate combustion chamber 11 positioned therebelow and having a front plate 12 and a back plate 13. The linear type burner 3 is arranged in the upper part of the inner space 14 of the combustion chamber 11. Heat energy generated in the combustion chamber 11 is transmitted through the front and back plates 12 and 13 to air being circulated about the outer face of the combustion chamber whereby the combustion chamber 11 essentially acts as a type of heat exchanger.

Figure 3:
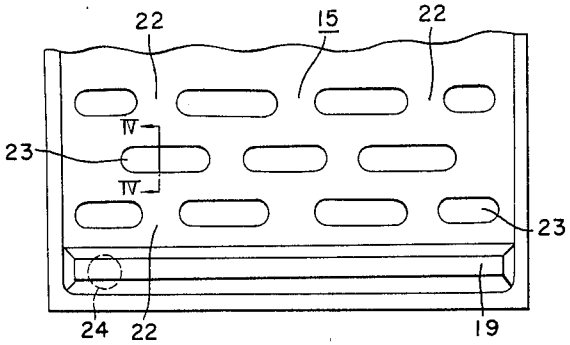
FIG. 3 is a front view of the heat exchanger shown in FIG. 1.
Figure 4:
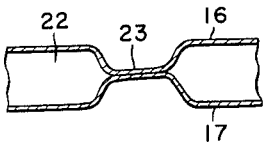
FIG. 4 is an enlarged cross-sectional view taken along the line IV—IV of FIG. 3.

A heat exchanger 15 having a front plate 16 and a back plate 17 and being of substantially a flat-shaped configuration is connected to the combustion chamber 11 so that the inner space 18 thereof is connected directly to the inner space 14 of the combustion chamber. Connected to the inner space 18 of the heat exchanger 15 is an exhaust gas duct 19 having a front plate 20 and a back plate 21. The front plates 12, 16 and 20 are formed from one piece of plate, and also, the back plates 13, 17 and 21 are formed from one piece of plate, to provide the combustion chamber 11, the heat exchanger 15 and the exhaust gas duct 19 in series relation. Thus, in the preparation of the combustion chamber 11, the heat exchanger 15 and the exhaust gas duct 19, the front plates 12, 16 and 20 and the back plates 13, 17 and 21 are respectively formed to desirable shapes by pressing, and the plates 16 and 17 are assembled so as to form a plurality of passages 22, as shown in FIGS. 3 and 4, and a plurality of contact portions 23 which are electrically welded or brazed. The front plates and back plates are respectively made of iron plate coated with a suitable heat resistant material.

The reference numeral 24 indicates an exhaust gas pipe connected to one edge of the exhaust gas duct 19. The gas generated from the linear type burner 3 and combusted in the combustion chamber 11 therefore is exhausted from the inner space 14 of the combustion chamber 11 through the inner space 18 of the heat exchanger 15 and though the exhaust gas duct 19 to the exhaust gas pipe 24. The system is substantially closed so as to prevent leakage of the combustion gas from all parts.

Guide plates 25 and 26 are provided between the front plates 12, 16 and 20 and the back plates 13, 17 and 21 and the sheath 2 with each guide plate being spaced from its respective front or back plates, whereby air supplied from the blower 27 at the bottom of the body 1 is led by the guide plates so as to pass concurrently along the front plates 12, 16 and 20 and the back plates 13, 17 and 21. The reference numeral 28 indicates an air inlet at the bottom for introducing air to the blower 27 through a filter 29, and 30 designates an air outlet in the upper regions of the unit for heated air.

Ignition is initially conducted by using a suitable igniter in the combustion chamber 11, not shown in the drawing. The arrow marks indicate the direction of flow of air or fuel gas. The operation of the room heating apparatus being constructed according to this invention as described is as follows:

Fuel gas injected from the linear type burner 3 is mixed with air supplied from the opening 10 and the mixture of gases is combusted in the combustion chamber 11. The combustion gas heated to high temperature is then passed through the inner space 14 of the combustion chamber 11 and the inner space 18 of the heat exchanger 15 to the exhaust gas duct 19 and is exhausted through the exhaust gas pipe 24 to the outdoors.

On the other hand, cool air being introduced by the blower 27 from the air inlet 28 at the bottom of the body 1 is divided to flow over both the front side and the back side of the apparatus at the lower edge of the front and back plates 20 and 21 forming the exhaust gas duct 19, whereupon the air rises through the passage between the front plates 20, 16 and 12 and the front guide plate 25 and the passage between the back plates 21, 17 and 13 and the rear guide plate 26, taking heat energy from the exhaust gas duct 19, the heat exchanger 15 and the combustion chamber 11 in series, to become gradually heated, so that upon exiting from the outlet 30 at the upper part of the body 1, it is blown off as hot or heated air.

It is quite important that the direction of the combustion gas flow designated by the arrow d is opposite to the direction of the flow of the air being heated which is designated by the arrow $\beta$. That is, the hot air flow is provided in the direction of increased heating, whereby the cool air being introduced is gradually heated so as to provide a high coefficiency of heat exchange. As to the structure, the burner 3 is provided in the upper part of the body 1 and the blower 27 is provided in the bottom of the body 1, such that the blower 27 is protected from severe heating by the burner 3. Thus, even should the blower 27 be accidentally stopped, it is protected from being damaged by the heat energy of the burner 3.

In this embodiment, the combustion chamber 11 and the heat exchanger 15 have especially long width and small thickness so as to be substantially flat in shape, as shown in FIG. 1, so that the heat transmission from the combustion gas to the front and back plates 12 and 13 of the combustion chamber 11 and the front and back plates 16 and 17 of the heat exchanger 15 is remarkably higher than those of combustion chambers having round or square shapes. Essentially, in this light, the shapes of the combustion chamber 11 and the heat exchanger 15 are considered to be substantially flat, which may be taken as meaning that the width or elongate dimension, as shown in FIG. 1, and the height as well, are more than ten times the thickness. More specifically, the terms of width and thickness mean the length of each of the two dimensions of a perpendicular sectional view, such as shown in FIG. 2 of the combustion gas flow in the inner spaces of the combustion chamber 11 and the heat exchanger 15.

According to experiments, the thermal efficiency of the room heating apparatus can be increased to about 90%, where the width and the height of the inner space are, respectively, more than ten times the thickness of the inner space. Such high thermal efficiency is unpredictable in comparison with conventional room heating apparatus for exhausting combustion gas to the outdoors, the thermal efficiency of which is only about 70%.

Figure 5:
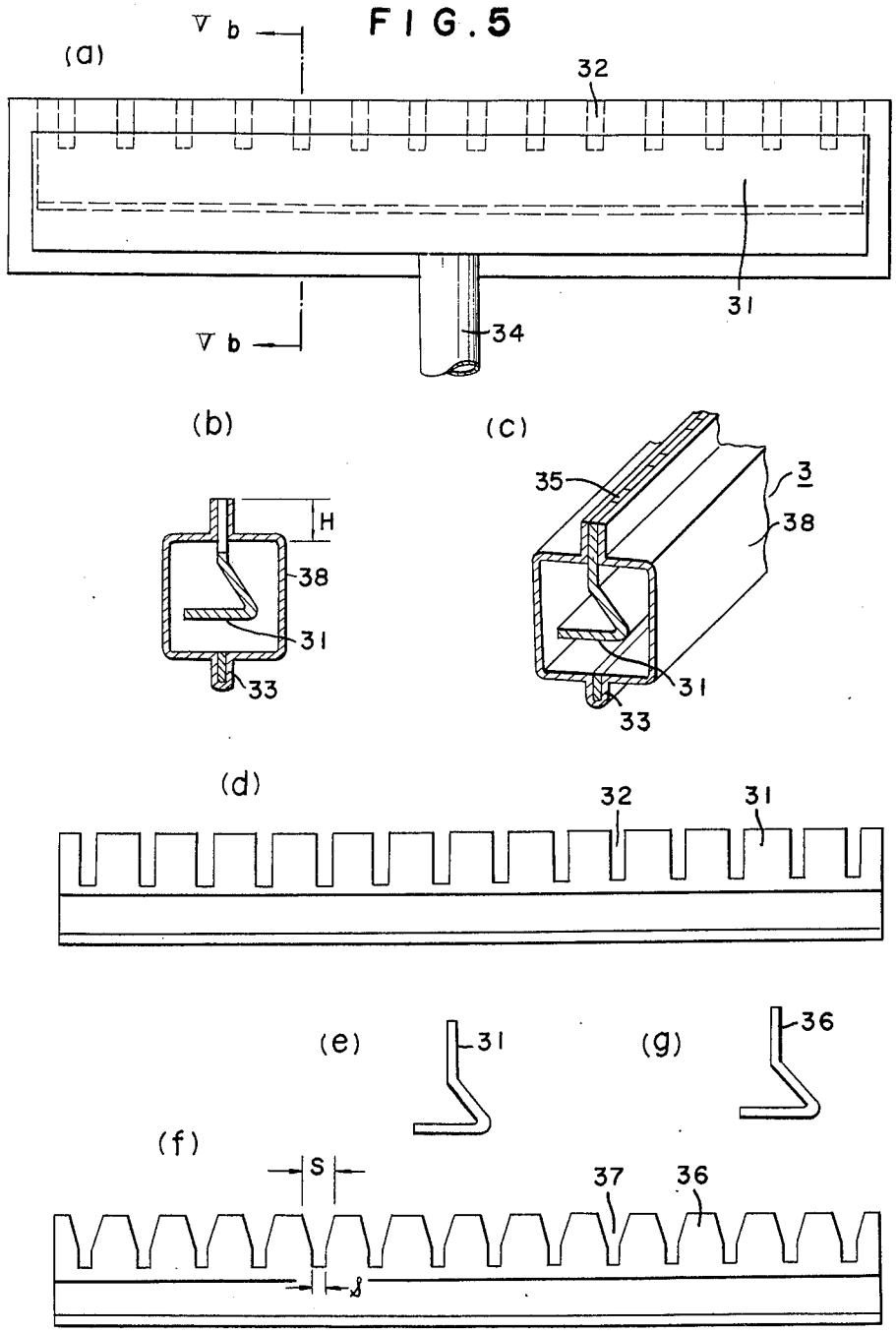
FIG. 5 shows another embodiment of the linear type burner wherein FIG. 5 (*a*) is a front view of the burner.

FIG. 5 shows another detailed embodiment of a linear type burner constructed according to this invention. It is necessary to use a stable burner to provide a compact heating apparatus. It is also necessary to prevent so called "lifting", wherein the bottom of the flame becomes separated from the flame holes of the burner, and to prevent "back-firing", wherein the fire or flame gets back into the flame holes of the burner. It is known that the likelihood of lifting and back-firing is dependent upon the depth of the flame holes.

The possibility of the lifting or the back-firing depends upon the velocity of the mixture of fuel gas and air at the flame holes, when that of a type of fuel gas and an amount of primary air for mixing therewith are the same. Since the lifting is in the opposite relation to back-firing on the velocity of the mixture of fuel gas and air, back-firing tends to occur by preventing lifting, while lifting tends to occur by preventing back-firing. Accordingly, it is necessary to carefully consider the structure of the burner.

In FIGS. 5(*a*) through 5(*e*), the reference numeral 38 indicates an outer wall of the linear type burner 3 which is prepared by pressing a metal plate to form a rectangular convex. A flame-hole plate 31 has a plurality of slits 32 provided on a vertical portion thereof being substantially rectangular in shape and equally spaced to form a comb-teeth-type configuration and the lower part of the plate is bent to form a horizontal arm. As shown in FIG. 5(*c*), the flame-hole plate 31 is set between two end plates of the outer walls 38 projecting from the rectangular convex at the top and is connected thereto by spot welding and a spacer 33 is placed between corresponding opposing ends of the outer walls 38 projecting from the rectangular convex at the bottom being welded thereto to form the burner 3.

The reference numeral 34 indicates a fuel-air inlet pipe for a mixture of fuel and air, which can be connected to one end of the linear burner, if preferred, instead of intermediate the ends, as shown. The slits 32 of the flame-hole plate 31 reach into the convex of the outer walls 38 whereby the holes having rectangular shape formed by the slits 32 and the outer walls 38 are used as the flame holes 35, shown in FIG. 5(*c*). Accordingly, the depth of the flame holes can be easily selected so that the possibilities of lifting and back-firing can be decreased. Although the velocity of the gas in the flame hole 35 is constant, lifting and back-firing can be prevented by properly selecting the depth of the flame holes. The outer walls 38 and the flame hole plate 31 of the burner are preferably made of stainless steel or the like. Another embodiment of the flame-hole plate is shown in FIGS. 5(*f*) and 5(*g*) being designated by the reference numeral 36, wherein the bottom of a slit 37 therein is horizontal and the upper part of the slit is V-shaped. Where the flame-hole plate 63 is used, back-firing can be prevented since the velocity of the gas is fast at the bottom of the slit, while lifting can be prevented since the velocity of the gas is slow at the upper edges of the holes, whereby combustion occurs in the best condition. According to experiments, it has been found that the best result can be obtained when the depth (H) of the flame holes supplying the city gas, natural gas or propane gas normally is in a range of 3–5mm., and the width of the slit being s at the bottom and S at the top edges is such that S is more than 2s. The shape of the slit is not limited to that of slit 37 of the flame-hole plate 36, but may take on other suitable shapes offering the same advantages.

Figure 6:
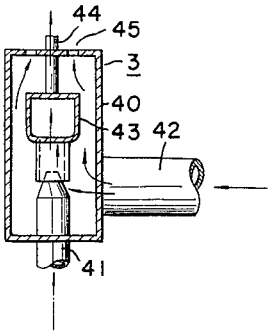
FIG. 6 shows yet another embodiment of the linear type burner wherein FIG. 6 (*a*) is a cross-sectional view taken along the line VI*a*–VI*a* of FIG. 6 (*b*).
Figure 6:
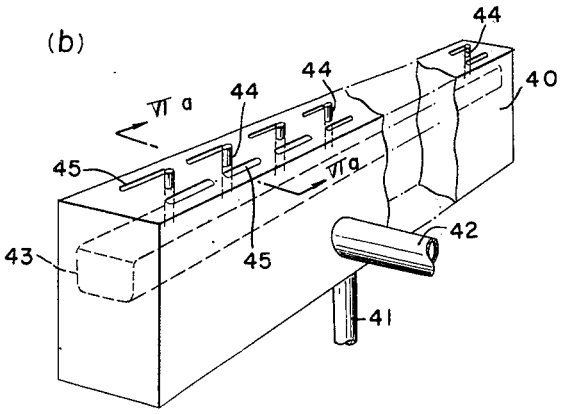

FIG. 6 shows still another embodiment of the linear type burner wherein the reference numeral 40 indicates the outer wall of the linear type burner 3 forming a rectangular convex. The reference numeral 41 indicates an inlet pipe for supplying fuel and 42 is an inlet pipe for supplying air. When fuel gas is injected from the fuel inlet pipe 41 to a duct 43, air is simultaneously aspirated from around the fuel inlet pipe through the inlet 42 so as to be primarily admixed with the fuel gas. A plurality of ducts 44 for dividing fuel gas are provided on the duct 43 being equally spaced apart and projecting from the outer wall 40 a length substantially equal to the diameters thereof. A plurality of openings 45 for air injection are provided near the dividing ducts 44 whereby air from the openings 45 is secondarily admixed with the fuel gas from the dividing ducts 44. In the linear type burner shown in FIG. 6, the flaming of combustion is slow and stable and noise caused by the combustion can be minimized.

The primary flame is formed by turbulent mixing of air and fuel gas around the edges of the dividing ducts 44 because of the following phenomenon. When air is passed through the openings 45, it is partially turbulent in its flow pattern. Also, a part of the fuel gas injected from the dividing ducts 44 to the space between the dividing ducts 44 and the outer wall 40 is in a negative pressure condition, and is convoluted with the air so as to be turbulently admixed with it. A secondary flame is formed with a small gap from each edge of the dividing duct 44 by slow mixing of the air with the fuel gas in a laminar flow. However, the initial point of the flame is stabilized by the primary flame.

Accordingly, as a whole, stable flame is formed from the edge of the dividing ducts 44 as a center of flame. It is also possible to use various other types of linear type burners meeting the objectives of the present invention.

Obviously, numerous modifications and variations of this invention are possible in light of the above teachings. It is to be understood, therefore, that within the scope of the appended claims, the invention may be practiced otherwise than as specifically described herein.

What is claimed as new and desired to be secured by Letters Patent of the United States is:

1. A room heating apparatus using combustion gas comprising:

a linear type burner having a comb-tooth shaped flame hole plate comprising a plurality of slits disposed between front and back burner outer walls, said slits being open from the bottom of said burner when in use and being used as flame holes, the depth of said flame holes being within the range of 3–15mm;

a combustion chamber having a substantially flat shape supporting said linear type burner in the upper part thereof and providing an inner space for conducting combustion for transmitting heat energy to the outside by heat exchange;

a first blower disposed adjacent to said combustion chamber for supplying combustion air to said linear type burner;

a heat exchanger having a substantially flat shape being disposed below said combustion chamber and having an inner space connected to the inner space of said combustion chamber for passing combustion gas from the inner space of said combustion chamber to the inner space of said heat exchanger for transmitting heat energy to the outside of the heat exchanger;

an exhaust duct disposed below said heat exchanger for exhausting combustion gas from the inner space of said heat exchanger to the outdoors; and a second blower independently operable of said first blower disposed below said heat exchanger for recycling air into the room by passing air over the outer surfaces of said heat exchanger and said combustion chamber.

2. A room heating apparatus according to claim 1, further comprising:

a fist guide plate means forming a first passage between one side of said combustion chamber and said heat exchanger; and second guide plate means forming a second passage between the other side of said combustion chamber and said heat exchanger whereby said second blower for recycling air into the room forces air through both said first and second passages to heat said air.

3. A room heating apparatus according to claim 1, wherein said second blower is disposed below said exhaust gas duct for recycling air into the room by passing it over the outer surfaces of said exhaust gas duct, said heat exchanger and said combustion chamber.

4. A room heating apparatus according to claim 3, further comprising:

first guide plate means forming a first passage between one side of said combustion chamber, said heat exchanger and said exhaust gas duct; and second guide plate means forming a second passage between the other side of said combustion chamber, said heat exchanger and said exhaust gas duct, whereby said second blower for recycling air into the room forces air through both said first and second passages to heat said air.

5. A room heating apparatus according to claim 1, wherein the width of said combustion chamber having a substantially flat shape is more than ten times the thickness thereof.

6. A room heating apparatus according to claim 1, wherein the width of said heat exchanger having a substantially flat shape is more than ten times the thickness thereof.

7. A room heating apparatus according to claim 1, wherein said combustion chamber and said heat exchanger have front plates which are formed in one piece by press-shaping a sheet of plate.

8. A room heating apparatus according to claim 1, wherein said combustion chamber and said heat exchanger have back plates which are formed in one piece by press-shaping a sheet of plate.

9. A room heating apparatus according to claim 1, wherein said slits of said comb-tooth shaped flame hole plate of said linear type burner comprise a plurality of parallel slits of uniform width throughout their lengths.

10. A room heating apparatus according to claim 1, wherein said slits of said comb-tooth shaped flame hole plate of said linear type burner comprise a plurality of slits being respectively parallel at one end thereof and V-shaped at the opposite ends thereof.

11. A room heating apparatus according to claim 10, wherein:

the width of each of said slits at said opposite end thereof is at least twice the width of each of said slits at said one end thereof.

* * * * *